US009181745B1

(12) United States Patent
Diep et al.

(10) Patent No.: US 9,181,745 B1
(45) Date of Patent: Nov. 10, 2015

(54) TRUNK CUSHION ASSEMBLY

(71) Applicant: NEWFREY LLC, Newark, DE (US)

(72) Inventors: Tien T. Diep, West Bloomfield, MI (US); Terri L. Wernert, China, MI (US)

(73) Assignee: NEWFREY LLC, Newark, DE (US)

( * ) Notice: Subject to any disclaimer, the term of this patent is extended or adjusted under 35 U.S.C. 154(b) by 0 days.

(21) Appl. No.: 14/283,873

(22) Filed: May 21, 2014

(51) Int. Cl.
*E05F 5/02* (2006.01)

(52) U.S. Cl.
CPC ..... *E05F 5/022* (2013.01)

(58) Field of Classification Search
CPC ..... Y10T 16/61; Y10T 16/625; Y10T 16/628; Y10T 16/6285; E05F 5/00; E05F 5/003; E05F 5/006; E05F 5/02; E05F 5/022; E05F 5/06; F16F 1/44; F16F 1/445; F16F 1/3732; F16F 1/3735; B65B 69/001; B60G 2204/4502
See application file for complete search history.

(56) References Cited

U.S. PATENT DOCUMENTS

| | | | | | |
|---|---|---|---|---|---|
| 351,509 | A | | 10/1886 | Hertz | |
| 1,655,777 | A | | 1/1928 | Weiland | |
| 2,367,657 | A | * | 1/1945 | Boersma | 52/511 |
| 2,596,780 | A | | 5/1952 | Meyers et al. | |
| 2,735,673 | A | * | 2/1956 | Muller | 267/292 |
| 2,813,712 | A | | 11/1957 | Stanis | |
| 2,817,510 | A | | 12/1957 | Hoban | |
| 3,118,659 | A | * | 1/1964 | Paulsen | 267/35 |
| 3,144,247 | A | | 8/1964 | Szonn et al. | |
| 3,305,227 | A | | 2/1967 | Henley | |
| 3,572,799 | A | * | 3/1971 | Truesdell et al. | 293/128 |
| 3,716,999 | A | | 2/1973 | Middelbeek | |
| 3,724,833 | A | | 4/1973 | Sergay | |
| 5,326,083 | A | | 7/1994 | Wydra et al. | |
| 5,725,203 | A | * | 3/1998 | Lloyd | 267/153 |
| 5,791,637 | A | | 8/1998 | Reichelt et al. | |
| 5,933,915 | A | * | 8/1999 | El Dessouky et al. | 16/82 |
| 6,039,388 | A | * | 3/2000 | Choi | 296/207 |
| 6,119,306 | A | * | 9/2000 | Antonucci et al. | 16/86 A |
| 6,209,170 | B1 | * | 4/2001 | Huynh | 16/86 A |
| 6,295,697 | B1 | * | 10/2001 | Simon | 16/86 R |
| 6,857,166 | B2 | | 2/2005 | Nakagaki et al. | |
| 7,114,217 | B2 | * | 10/2006 | Matsuzawa et al. | 16/2.2 |
| 7,168,130 | B2 | * | 1/2007 | Shin | 16/82 |

(Continued)

FOREIGN PATENT DOCUMENTS

| | | |
|---|---|---|
| JP | 08200420 | 8/1996 |
| JP | 2002349524 | 12/2002 |

(Continued)

*Primary Examiner* — Chuck Mah
(74) *Attorney, Agent, or Firm* — Harness, Dickey & Pierce, P.L.C.

(57) ABSTRACT

A cushion member assembly includes an attachment fastener having deflecting first and second arms curving toward a planar flange, and a neck region connecting the first and second arms to the planar flange. A cushion member includes a slot in a body first portion first end and a body second portion having a hollow chamber. A first bore extends into the body first portion from the slot. A second bore has a diameter larger than a first bore diameter and substantially equal to a first and second arm spaced width. A surface separates a cavity defined by the second bore from the first bore. The arms initially deflect toward each other during entrance into the first bore and outwardly rebound in the second bore directly contacting the surface. The first and second arms in contact with the surface resist removal of the attachment fastener from the cushion member.

20 Claims, 7 Drawing Sheets

(56) References Cited

U.S. PATENT DOCUMENTS

| | | | | |
|---|---|---|---|---|
| 7,384,226 | B2 * | 6/2008 | Jones et al. | 411/508 |
| 7,566,081 | B2 | 7/2009 | Aoyama | |
| 8,052,233 | B2 * | 11/2011 | Netzer et al. | 312/330.1 |
| 8,291,547 | B2 | 10/2012 | Ukai et al. | |
| 8,382,078 | B2 | 2/2013 | Okada et al. | |
| 8,407,857 | B2 | 4/2013 | Sugiyama | |
| 8,677,563 | B2 * | 3/2014 | Diep et al. | 16/82 |
| 8,991,537 | B2 * | 3/2015 | Snede et al. | 180/69.2 |
| 2005/0145767 | A1 | 7/2005 | Nakagaki et al. | |
| 2005/0230891 | A1 * | 10/2005 | Griffin | 267/292 |
| 2010/0192335 | A1 | 8/2010 | Ukai et al. | |
| 2011/0030177 | A1 * | 2/2011 | Ukai et al. | 24/458 |
| 2011/0079943 | A1 * | 4/2011 | Wolf et al. | 267/141 |
| 2011/0167590 | A1 | 7/2011 | Ukai et al. | |
| 2012/0246896 | A1 | 10/2012 | Kaji et al. | |

FOREIGN PATENT DOCUMENTS

| | | |
|---|---|---|
| JP | 2003202043 | 7/2003 |
| JP | 2005343284 | 12/2005 |
| JP | 2006097326 | 4/2006 |
| JP | 2006349143 | 12/2006 |
| JP | 2007225093 | 9/2007 |
| JP | 2008111451 | 5/2008 |
| JP | 2008196651 | 8/2008 |
| JP | 2009222074 | 10/2009 |
| JP | 2010001967 | 1/2010 |
| JP | 2010151179 | 7/2010 |
| JP | 2011025749 | 2/2011 |
| JP | 2011064292 | 3/2011 |
| JP | 2011064293 | 3/2011 |

* cited by examiner

TRUNK CUSHION ASSEMBLY

FIELD

The present disclosure relates to resilient material dampers or cushions used to absorb component impact forces from automobile vehicle trunk lid or door opening/closing operations and an attachment device for connecting such dampers to automobile vehicle structure or panels.

BACKGROUND

This section provides background information related to the present disclosure which is not necessarily prior art.

Automobile trunk lids are normally manually opened with the assistance of a mechanism including opposed trunk arms that are connected between the trunk lid and panel or structure of the vehicle body. Trunk lids may have their motion assisted to reduce the lifting force required by the operator and/or may contact rubber or resilient material bumpers at the end of arm travel to stop trunk lid travel. At present, if a vehicle trunk lid is opened too quickly, and particularly when newer design reduced resistance trunk lid mechanisms are used, the lid will rebound or bounce off away from the rubber stops used to absorb and dampen this travel, and can either block access to the trunk, requiring a second opening action, or strike the operator.

SUMMARY

This section provides a general summary of the disclosure, and is not a comprehensive disclosure of its full scope or all of its features.

According to several aspects, a cushion member assembly includes an attachment fastener having deflecting first and second arms each having an end face directed toward a planar flange such that the first and second arms define a mushroom shape. A resilient material cushion member includes: a body first portion; a body second portion having a hollow chamber, the body second portion integrally connected to the body first portion; a first bore extending into the body first portion; and a second bore opening into the first bore, the second bore having a diameter larger than a diameter of the first bore and substantially equal to a spaced width of the first and second arms. A surface separates a cavity defined by the second bore from the first bore. The first and second arms are in contact with the surface in an attachment fastener installed position thereby resisting removal of the attachment fastener from the cushion member.

According to other aspects, a cushion member assembly includes an attachment fastener having deflecting first and second arms curving toward a planar flange, and a first neck region connecting the first and second arms to the planar flange. A resilient material cushion member includes a counter-bore slot created in a first end of a body first portion and a body second portion having a hollow chamber. A first bore extends into the body first portion from the counter-bore slot. A second bore has a diameter larger than a diameter of the first bore and substantially equal to a spaced width of the first and second arms. A surface separates a cavity defined by the second bore from the first bore. The first and second arms initially deflect toward each other during entrance into the first bore and outwardly rebound in the second bore and directly contacting the surface. The first and second arms in contact with the surface resist removal of the attachment fastener from the cushion member.

According to further aspects, a trunk cushion member assembly includes an attachment fastener having deflecting first and second arms each having an end face directed toward a planar flange such that the first and second arms define a mushroom shape. A resilient material cushion member includes a body first portion and a body second portion having a hollow chamber, the body second portion integrally connected to the body first portion. A first bore extends into the body first portion. A second bore opens into the first bore, the second bore having a diameter larger than a diameter of the first bore and substantially equal to a spaced width of the first and second arms. A surface separates a cavity defined by the second bore from the first bore. The first and second arms contact the surface in an attachment fastener installed position thereby resisting removal of the attachment fastener from the cushion member. A first neck region integrally connects the first and second arms to the planar flange, wherein the first and second arms and the first neck region together define a cushion engagement portion entirely received in the first and second bores of the body first portion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
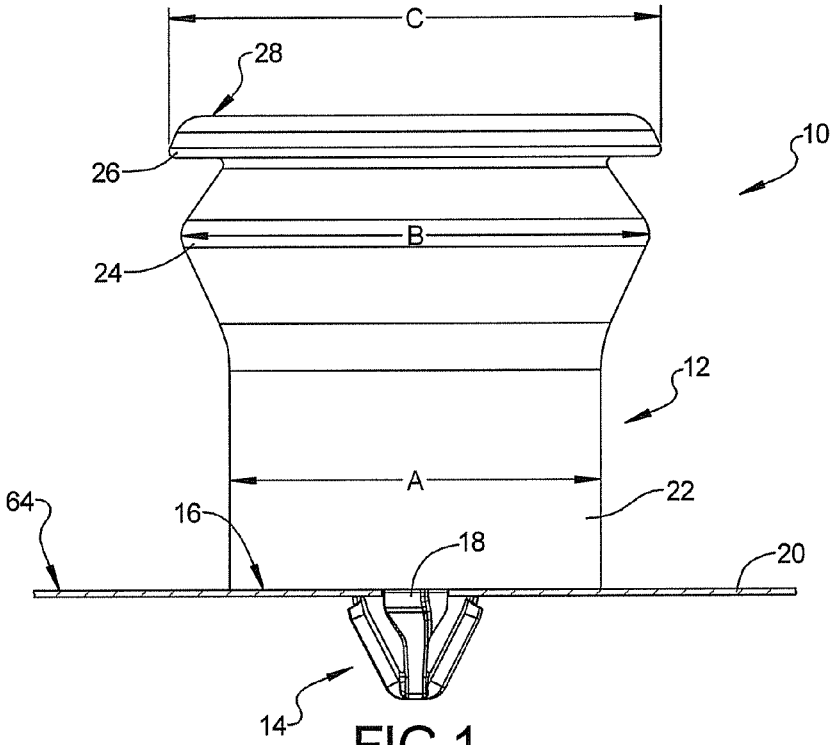
FIG. 1 is a front elevational view of a cushion member assembly of the present disclosure.

Referring to FIG. 1, a cushion member assembly 10, which according to several aspects defines a trunk cushion assembly, includes a multiple diameter or bell-shaped cushion member 12 made for example from a resilient material such as EPDM (ethylene propylene diene monomer) having a predetermined Shore A durometer that can range between approximately 25 to 80. Although cushion member assembly 10 is described in reference to use for a vehicle trunk cushion, cushion member assemblies 10 of the present disclosure can be used in any application where similar dampening characteristics are required. An attachment fastener 14 extending from a first end 16 of cushion member 12 is initially compressed to be received in an aperture 18 of a body panel 20 and then expands to its original size to thereafter act to resist removal of cushion member 12 from body panel 20.

Cushion member 12 further includes a body first portion 22 positioned proximate to attachment fastener 14 which is substantially solid and has a minimum first diameter "A". Cushion member 12 further includes a body second portion 24 integrally connected to first portion 22, which is substantially hollow, and has a maximum second diameter "B" which is larger than first diameter "A" of first portion 22. A body third portion 26 defining a flange is connected to second portion 24 and has a third diameter "C" equal to, or greater than second diameter "B" of second portion 24. Third portion 26 provides an increased surface area to contact a component 66 shown and described in reference to FIG. 3, thereby inducing cushion member 12 to elastically longitudinally compress when a load or force is applied in a loading direction "D" to an end flange 28 of cushion member 12. After compression, cushion member 12 rebounds to a non-compressed state (shown in FIG. 1) after the force is absorbed and/or is dissipated by compression and expansion of cushion member 12.

Figure 2:
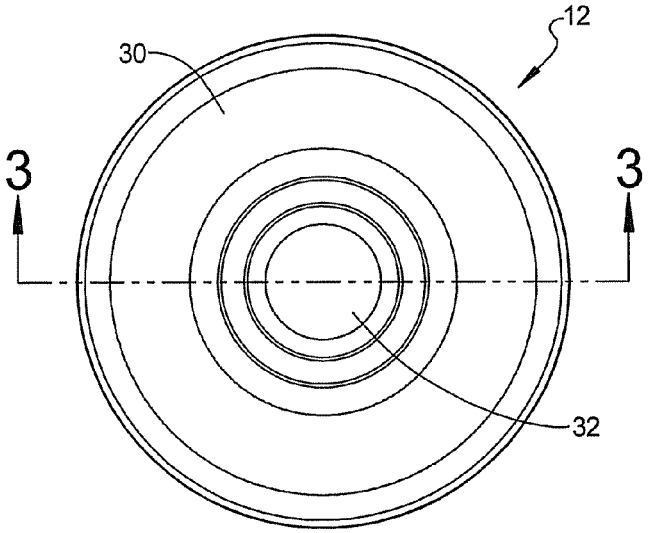
FIG. 2 is a top plan view of the cushion member assembly of FIG. 1.

Referring to FIG. 2, the second portion 24 of cushion member 12 is substantially hollow, thereby creating a hollow chamber 30 which is normally filled with air at atmospheric pressure. According to several embodiments, a raised surface 32 can extend from first portion 22 directed into chamber 30. Raised surface 32 can act as a contact point defining the limit or maximum deflection of the second and third portions 24, 26.

Referring to FIG. 3 and again to FIG. 1, the attachment fastener 14 has a mushroom shaped portion 34 defining a first engagement end 36, which includes opposed, deflectable first and second arms 38, 40 which inwardly deflect toward each other as first engagement end 36 of attachment fastener 14 is pressed parallel to the loading direction "D" into a first bore 42 created in the first end 16 of cushion member 12. The first and second arms 38, 40 are both curved downwardly as viewed in FIG. 3 in their as-molded condition and directed toward a planar flange 50. The downward curving geometry of first and second arms 38, 40 is important in initially directing the first and second arms 38, 40 oppositely with respect to the loading direction "D" such that if the installed attachment fastener 14 is pulled in a releasing direction "E" the pulling force is transferred through an axis of the first and second arms 38, 40 allowing part of the force to act in compression of the first and second arms 38, 40.

Figure 11:
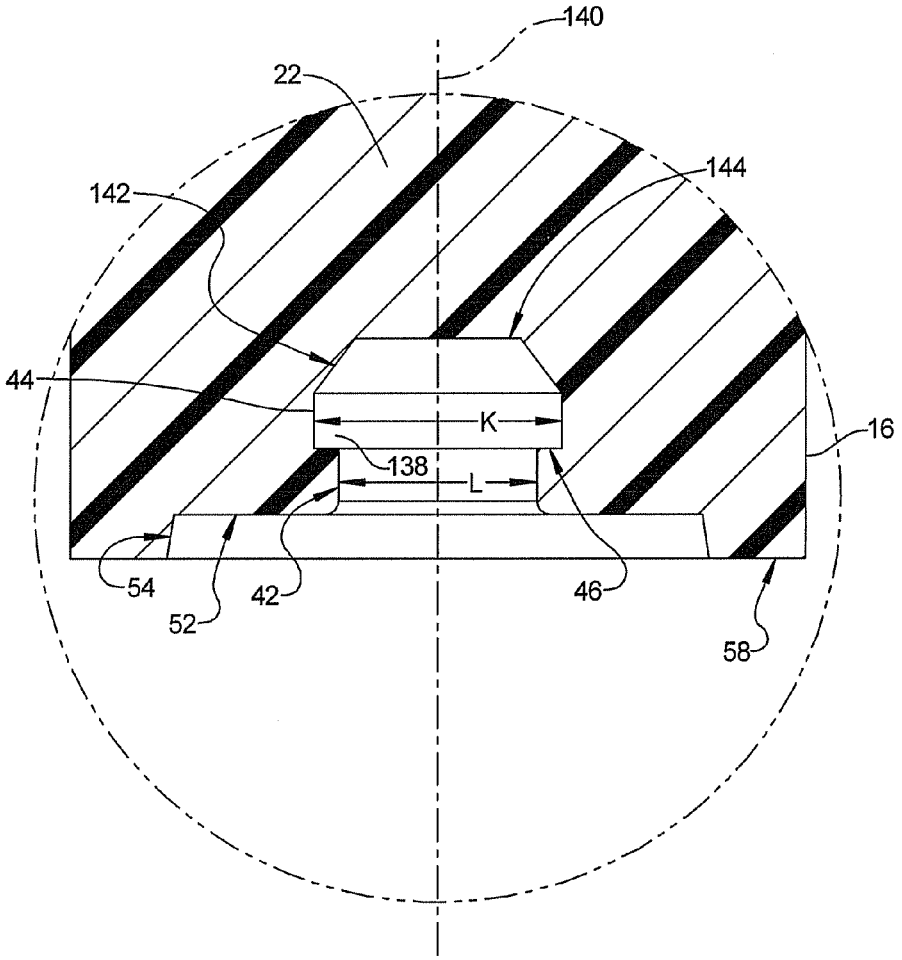
FIG. 11 is a cross sectional front elevational view of area 11 of FIG. 3 with the attachment fastener removed for clarity.

During installation of attachment fastener 14, the first and second arms 38, 40 exit the first bore 42 and enter a larger diameter second bore 44 of cushion member 12 which is co-axially aligned with the first bore 42 and larger in diameter than the diameter of the first bore 42 as shown and described in reference to FIG. 11. Within second bore 44 the first and second arms 38, 40 oppositely and outwardly rebound and end faces 45, 45' of the first and second arms 38, 40 engage against a shelf or surface 46 oriented transverse to the walls of first and second bores 42, 44. The installation of attachment fastener 14 into second bore 44 is therefore intended to be a permanent installation. Thereafter, if the attachment fastener 14 is pulled in the releasing direction "E" opposite to the loading direction "D" tending to release attachment fastener 14, direct contact between the first and second arms 38, 40 at end faces 45, 45' with surface 46 prevents removal of attachment fastener 14.

A first neck region 48 is substantially equal in width to a diameter of first bore 42 and therefore frictionally contacts opposed wall portions of the first bore to prevent attachment fastener 14 from moving horizontally when engaged with cushion member 12. The planar flange 50 extends radially outward from neck region 48 and abuts a face 52 of cushion member 12 created within a recessed counter-bore slot 54 which is recessed with respect to an end face 56 of the first end 16. In the installed position of attachment fastener 14, an outward facing surface 58 of planar flange 50 is aligned substantially co-planar with end face 56 of first end 16. With reference again to FIG. 1, when the attachment fastener 14 is received in the aperture 18 of body panel 20, opposed, deflectable first and second wings 60, 62 of attachment fastener 14 prevent release of attachment fastener 14 from engagement with body panel 20, and both the end face 56 and the outward facing surface 58 abut a panel surface 64 of body panel 20.

Figure 3:
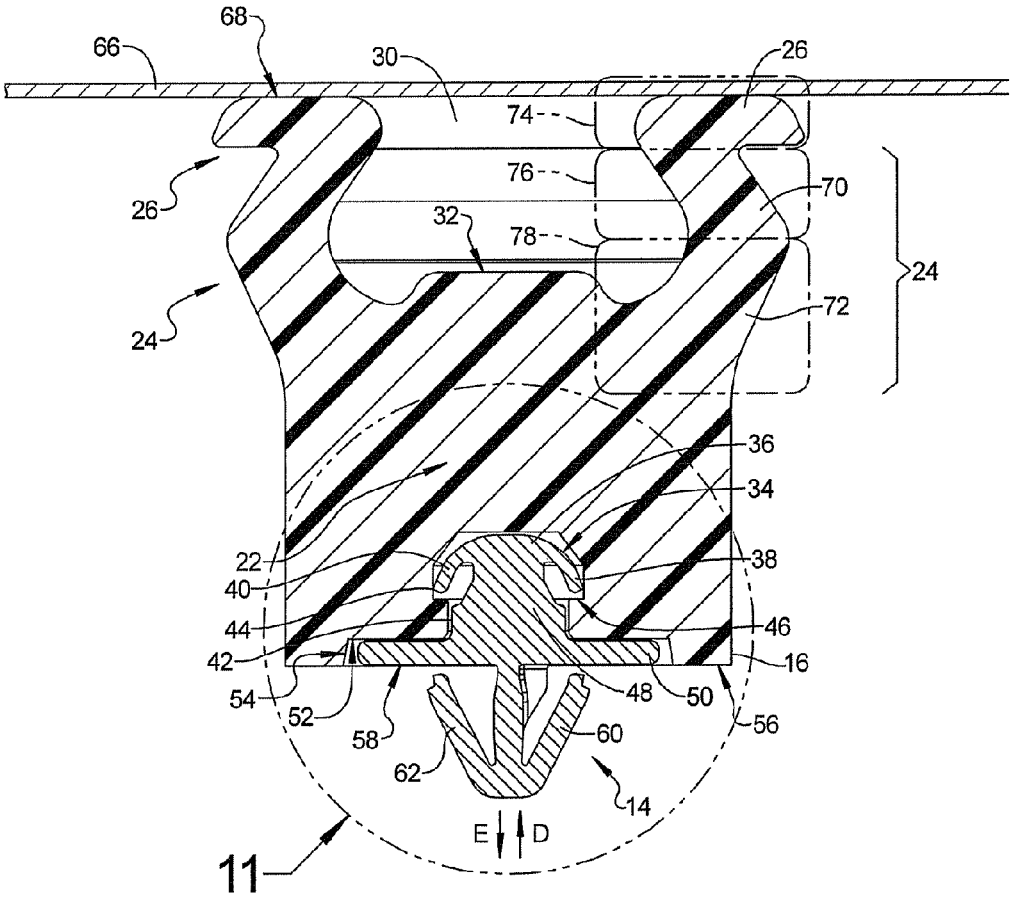
FIG. 3 is a cross sectional front elevational view taken at section 3 of FIG. 2.

With continuing reference to FIG. 3, the second and third portions 24, 26 of cushion member 12 together allow for a 3-stage compression during contact with a component 66 such as an arm supporting a vehicle trunk lid. The first stage of compression occurs as the flange 26, having a planar component surface 68, contacts the component 66 which is substantially parallel to the horizontal surface 68. The second stage of compression occurs as an inwardly directed leg 70 of the second portion 24, which is directly connected to flange 26, begins to both compress and outwardly deflect. The third stage of compression occurs as an outwardly directed leg 72 of the second portion 24, which is directly connected to the inwardly directed leg 70, compresses and outwardly bends. A final fourth stage of compression can occur after the component 66 contacts the raised surface 32, which thereafter causes compression of the solid but resilient body of first portion 22. Because air initially at atmospheric pressure is trapped in the hollow chamber 30 by contact between the flange 26 and the component 66, air pressure can build within hollow chamber 30 during deflection of the inwardly and outwardly directed legs 70, 72. Increasing air pressure also acts to resist deflection of the inwardly and outwardly directed legs 70, 72. The different stages of compression occur in different zones of the cushion member 12, and define a first zone 74, a second zone 76 and a third zone 78.

Figure 4:
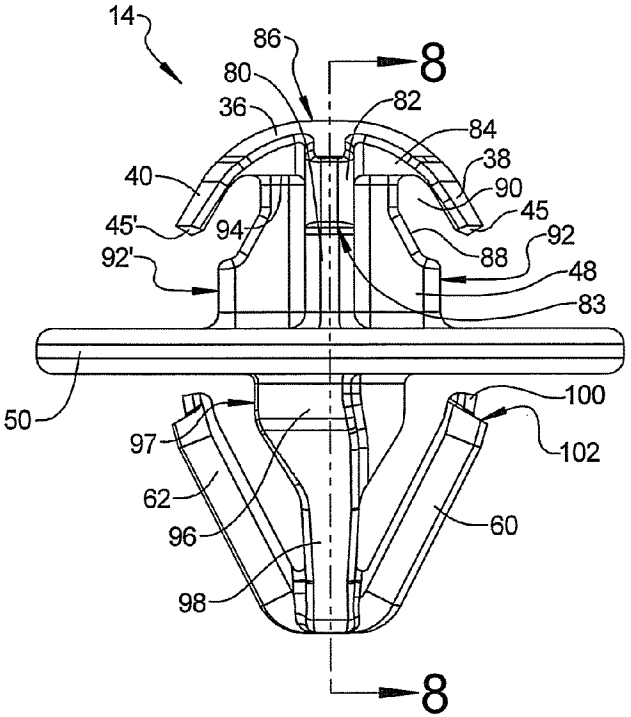
FIG. 4 is a front elevational view of an attachment fastener defining a portion of the cushion member assembly of the present disclosure.

Referring to FIG. 4, the attachment fastener 14 further includes a second neck region 80 integrally extending from the first engagement end 36 and connected to the planar flange 50. Second neck region 80 is transversely oriented with respect to the first neck region 48. A first non-deflectable head 82 extends outwardly from the second neck region 80 and thereby defines an engagement tooth 83. Each of the first and second arms 38, 40, as well as the second neck region 80, integrally extends from a non-deflectable portion 84 of the first engagement end 36. The first engagement end 36 further includes a curved end face 86 defining a free end of first engagement end 36.

Each of the first and second arms 38, 40 extend outwardly from the first neck region 48 such that an inwardly curved shoulder 88 is defined between each of the first and second arms 38, 40 and the first neck region 48. The inwardly curved shoulders 88 provide for a deflection zone 90, allowing the inward deflection of the first or second arms 38, 40 to permit the first engagement end 36 to be received in the first bore 42 of body first portion 22. When deflected inwardly, each of the first and second arms 38, 40 occupy the deflection zone 90 on opposite sides of first neck region 48, such that the first and second arms 38, 40 are each positioned substantially even with or recessed with respect to opposed outer surfaces 92, 92' at opposite sides of the first neck region 48. The first neck region 48 and the first engagement end 36 are integrally joined at a connecting surface 94 which, according to several aspects, is oriented substantially parallel to the planar flange 50. This provides for each of the first and second arms 38, 40 to be spaced away equally from the planar flange 50.

With continuing reference to FIG. 4 and again to FIG. 3, a third neck region 98 integrally supports each of the first and second wings 60, 62. A fourth neck region 96, together with the third neck region 98, is oppositely positioned about the planar flange 50 with respect to first neck region 48. Similar to the function of outer surfaces 92, 92', which is to slidably contact the inner wall of first bore 42, an outer surface 97 of the fourth neck region 96 is sized to similarly contact an inner wall of the aperture 18. Each of the first and second wings 60, 62 also includes at free ends thereof an engagement boss 100 which extends upwardly with respect to an engagement shoulder 102 which defines the free end of both the first and second wings 60, 62. The function of engagement boss 100 is to contact the inner wall of aperture 18, thereby allowing direct contact with an underside surface of the body panel 20 which is oppositely facing with respect to panel surface 64.

Referring to FIG. 5 and again to both FIGS. 3 and 4, in addition to the first and second arms 38, 40 and the first non-deflectable head 82, a second non-deflectable head 104 is oppositely directed with respect to the first non-deflectable head 82. The second non-deflectable head 104 provides an engagement tooth 105 similar to the engagement tooth 83. Each of the first and second non-deflectable heads 82, 104 are frictionally forced through the first bore 42 of body first portion 22 to further assist in the frictional retention of attachment fastener 14. In the installed position of attachment fastener 14 shown in FIG. 3, the engagement teeth 83, 105 of the first and second non-deflectable heads 82, 104 also both directly contact the surface 46 together with the end faces 45, 45' of the first and second arms 38, 40 to resist removal of attachment fastener 14. Each of the first and second wings 60, 62 at the location of engagement shoulders 102 further include a convex surface 106 to assist in the entry of the first and second wings 60, 62 into aperture 18.

Figure 5:
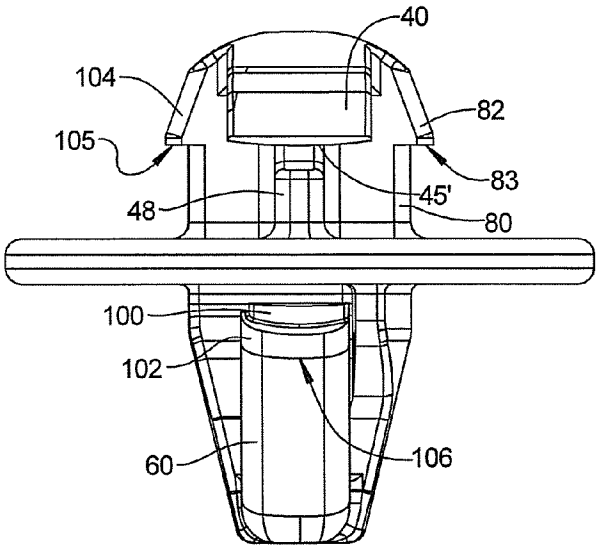
FIG. 5 is an end elevational view of the attachment fastener of FIG. 4.
Figure 6:
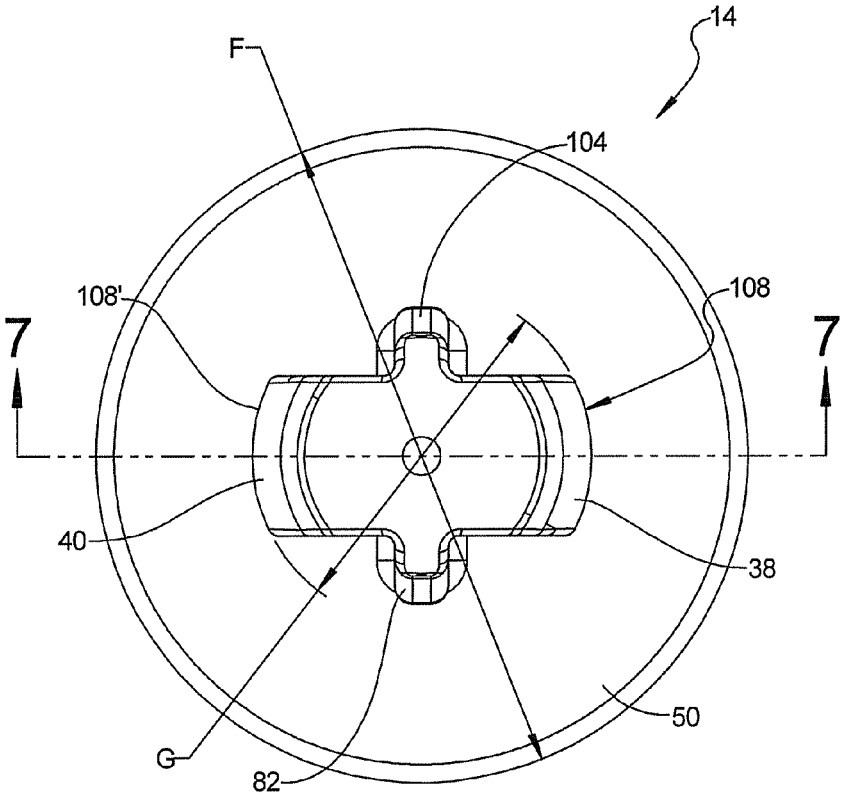
FIG. 6 is a top plan view of the attachment fastener of FIG. 4.

Referring to FIG. 6 and again to FIGS. 4-5, each of the first and second arms 38, 40 further includes an arm convex surface 108, 108' that assists with entry of the first and second arms 38, 40 into first bore 42. Each of the first and second non-deflectable heads 82, 104 is positioned within an arc or diameter defined by the arm convex surfaces 108, 108' of first and second arms 38, 40 in their as-molded condition. This permits the first and second arms 38, 40 to inwardly deflect upon entrance into first bore 42.

Figure 7:
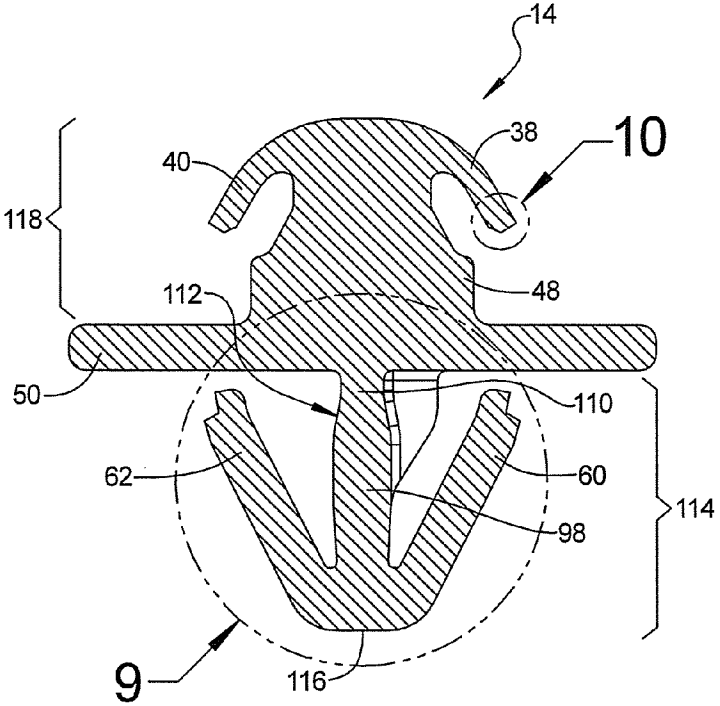
FIG. 7 is a cross sectional front elevational view taken at section 7 of FIG. 6.

Referring to FIG. 7 and again to FIGS. 3-6, the third neck region 98, at its connection location with the planar flange 50, can be provided with a narrow neck portion 110, which then tapers outwardly using a neck transition portion 112 to reach a full thickness of the third neck region 98. The narrow neck portion 110 therefore is narrower than the third neck region 98. Narrow neck portion 110 thereby provides a bend location for deflection of third neck region 98 during insertion of the first and second wings 60, 62. The first and second wings 60, 62 and the third neck region 98 together define a component engagement portion 114 of attachment fastener 14. Component engagement portion 114 extends away from planar flange 50 and provides a flat end face 116 at the location of insertion into aperture 18. Directed from an oppositely facing surface of the planar flange 50, the first and second arms 38, 40 and the first neck region 48 together define a cushion engagement portion 118, which as previously described is engaged within the first and second bores 42, 44 of body first portion 22. All of the components of attachment fastener 14 can be made from a polymeric material, for example in a molding operation or from another suitable material such as metal. A polymeric material, according to several aspects, is desired for minimizing the potential for removing paint or scratching the surface of the body panel 20 during installation.

Figure 8:
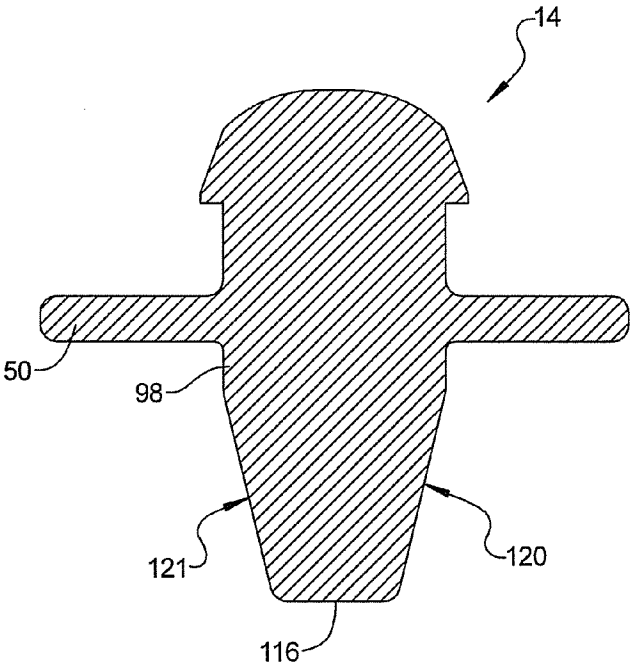
FIG. 8 is a cross sectional end elevational view taken at section 8 of FIG. 4.

Referring to FIG. 8 and again to FIGS. 3-7, opposed first and second tapered edges 120, 121 of the third neck region 98 extend downwardly away from the planar flange 50. The tapering geometry of the third neck region 98 also helps during insertion of the first and second wings 60, 62.

Figure 9:
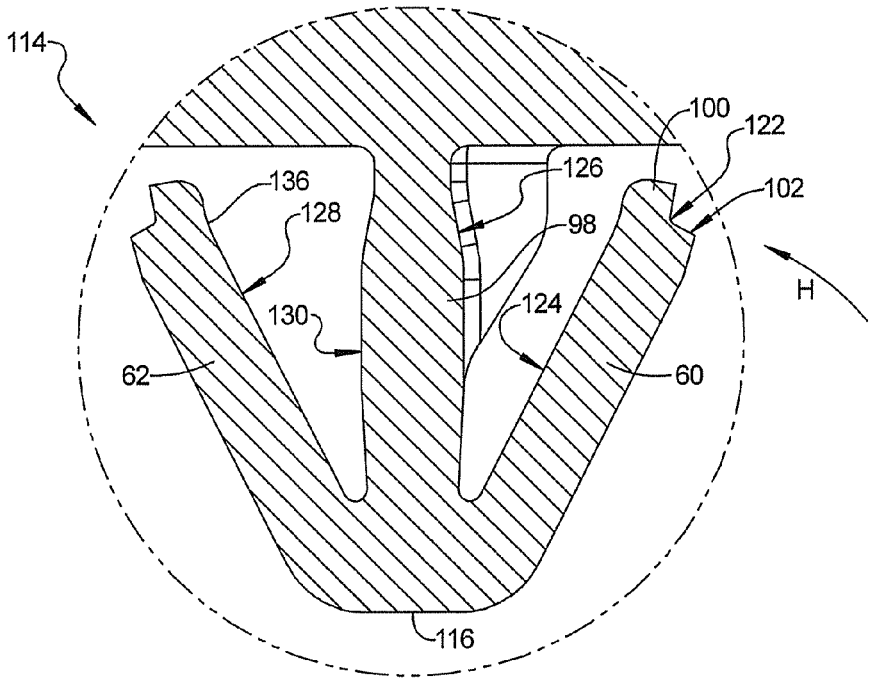
FIG. 9 is a cross sectional front elevational view of area 9 of FIG. 7.

Referring to FIG. 9 and again to FIGS. 1 and 3-8, a concave wall portion 122 is defined between the engagement boss 100 and the engagement shoulder 102 provided at each free end of the first and second wings 60, 62. The concave wall portion 122 provides for engagement with the underside surface of body panel 20. A wing interface 124 of first wing 60 faces and contacts a neck interface 126 of third neck region 98 during elastic deflection of the first wing 60 toward the third neck region 98 about an arc of rotation "H". Similarly, a wing interface 128 of second wing 62 also faces and directly contacts a neck interface 130 of third neck region 98 when both of the first and second wings 60, 62 enter aperture 18 of body panel 20. An inner bend region 136 positioned opposite to the engagement shoulder 102 in each of the first and second wings 60, 62 orients the engagement boss 100 to be aligned with the aperture 18 of the body panel 20 when the first and second wings 60, 64 contact the lower surface of the body panel 20.

Figure 10:
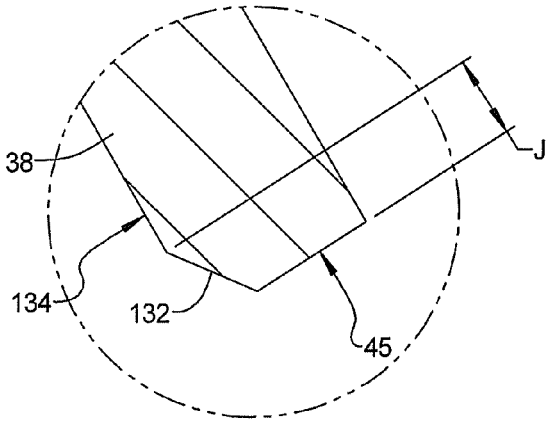
FIG. 10 is a cross sectional front elevational view of area 10 of FIG. 7.

Referring to FIG. 10 and again to FIGS. 3-7, each of the first and second arms 38, 40 (only first arm 38 is shown in this view) includes a chamfer 132 at the intersection of an arm inner wall 134 and the end face 45 (end face 45' of second arm 40 is not shown in this view). The chamfer 132 has a chamfer length "J". The chamfer 132 eliminates a sharp corner at the intersection of the arm inner wall 134 and the end face 45 and thereby reduces frictional resistance between the end faces 45, 45' and surface 46 allowing the first and second arms 38, 40 to more easily rebound to their fully extended positions within second bore 44. Chamfer length "J" is predetermined to maximize the surface area of end faces 45, 45' in contact with surface 46 while reducing friction as the first and second arms 38, 40 outwardly rebound in second bore 44.

Referring to FIG. 11 and again to FIGS. 3-10, a cavity 138 created in the body first end 16 of body first portion 22 is created during molding of cushion member 12. The geometry of the cavity 138 is specifically intended to capture features of the attachment fastener 14 while also allowing frictional engagement with portions of attachment fastener 14, thereby minimizing the horizontal or side-to-side displacement of attachment fastener 14 and preventing its withdrawal. The first bore 42 opens directly into the counter-bore slot 54 created at the outward facing surface 58. The second bore 44 is co-axially aligned with the first bore 42 on a body longitudinal axis 140. The second bore 44 has a larger diameter "K" than a diameter "L" of first bore 42 and, as depicted in FIG. 3, is sized to allow for full elastic rebound of the first and second arms 38, 40 within cavity 138 such that the end faces 45, 45' of each of the first and second arms 38, 40 engage surface 46. A conical surface 142 is created between the inner wall defined by second bore 44 and an end wall 144 of cavity 138. The conical shape of conical surface 142 is provided such that first and second arms 38, 40 are snugly received within cavity 138, at their extended or rebounded position, fully capturing the features of cushion engagement portion 118. The geometry of cavity 138 therefore closely mimics the mushroom-shaped geometry of cushion engagement portion 118. Because of the resilient material properties of cushion member 12, the frictional fit of the cushion engagement portion 118 within cavity 138 also helps prevent the release of attachment fastener 14 after insertion and engagement within the cushion member 12 to the attachment fastener installed or engaged position (shown in FIG. 3).

Cushion member assemblies of the present disclosure offer several advantages. The cushion member provides a cavity that is shaped to closely couple with expanded arms 38, 40 and engagement teeth 83, 105 of plastic attachment fastener 14. The attachment fastener 14 further includes deflectable wings 60, 62 positioned outwardly of the cushion member to engage the cushion member and attachment fastener as an assembly to a vehicle body or panel. The cushion member has a recess at a second end opposite to a deflectable portion where a flange of the assembly fastener is seated such that the flange and a resilient material end portion of the second end abut flush with a vehicle panel.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cushion member assembly, comprising:

an attachment fastener having deflecting first and second arms each having an end face directed toward a planar flange of the fastener such that the first and second arms define a curved mushroom shape; and a resilient material cushion member having:

a body first portion;

a body second portion having a hollow chamber, the body second portion integrally connected to the body first portion;

a first bore extending into the body first portion;

a second bore opening into the first bore, the second bore defining a cavity having a diameter larger than a diameter of the first bore and substantially equal to a spaced width of the first and second arms; and a surface separating the cavity defined by the second bore from the first bore, the first and second arms in contact with the surface in an installed position of the attachment fastener thereby resisting removal of the attachment fastener from the cushion member.

2. The cushion member assembly of claim 1, further including a counter-bore slot created in a first end of the body first portion, with the first bore opening into the counter-bore slot.

3. The cushion member assembly of claim 2, wherein the planar flange is entirely received in the counter-bore slot such that an outward facing surface of the planar flange is oriented co-planar with an end face of the first end.

4. The cushion member assembly of claim 1, wherein the first and second arms initially deflect toward each other during entrance into the first bore and outwardly rebound into the second bore in the attachment fastener installed position and directly contact the surface.

5. The cushion member assembly of claim 1, wherein the first bore opens into the counter-bore slot and extends into the body first portion away from the counter-bore slot.

6. The cushion member assembly of claim 1, wherein the second bore is co-axially aligned with the first bore.

7. The cushion member assembly of claim 1, further including a first neck region connecting the first and second arms to the planar flange, the first neck region having a width substantially equal to a diameter of the first bore such that the first neck region is frictionally engaged to the cushion member in the first bore.

8. A cushion member assembly, comprising:

an attachment fastener having deflecting first and second arms curving toward a planar flange of the fastener, and a first neck region connecting the first and second arms to the planar flange; and a resilient material cushion member having:

a counter-bore slot created in a first end of a body first portion;

a body second portion having a hollow chamber;

a first bore extending into the body first portion from the counter-bore slot;

a second bore having a diameter larger than a diameter of the first bore and substantially equal to a spaced width of the first and second arms; and a surface separating a cavity defined by the second bore from the first bore, the first and second arms initially deflecting toward each other during entrance into the first bore and outwardly rebounding in the second bore and directly contacting the surface, the first and second arms in contact with the surface thereby resisting removal of the attachment fastener from the cushion member.

9. The cushion member assembly of claim 8, further including a conical surface extending inwardly into the body first end from the second bore, the conical surface extending to an end wall, the second bore, the conical surface and the end wall together defining a cavity substantially matching a mushroom shape of the attachment member first and second arms.

10. The cushion member assembly of claim 9, further including a curved end face of the attachment fastener, the curved end face contacting the end wall simultaneously when the planar flange contacts a face of the counter-bore slot in the installed position of the attachment fastener.

11. The cushion member assembly of claim 8, wherein a width of the first neck region is substantially equal to the diameter of the first bore thereby permitting frictional engagement of the first neck region in the first bore.

12. The cushion member assembly of claim 8, wherein each of the first and second arms includes a chamfer created on an arm inner wall proximate to an end face, the chamfer reducing friction as the end face contacts the surface when the first and second arms rebound outwardly into the second bore.

13. The cushion member assembly of claim 8, wherein an outward facing surface of the planar flange is linearly co-aligned with an end face of the body first portion when the planar flange is received in the counter-bore slot.

14. The cushion member assembly of claim 8, wherein the attachment fastener further includes a second neck region oriented transverse to the first neck region, the second neck region having opposed first and second non-deflectable heads extending outwardly with respect to the second neck region creating first and second engagement teeth which directly contact the surface.

15. The cushion member assembly of claim 14, wherein the attachment fastener further includes:

a third neck region oppositely directed with respect to the planar flange from the first and second neck regions; and first and second deflectable wings integrally connected to the third neck region oppositely directed with respect to each other each having an engagement shoulder facing toward the planar flange.

16. The cushion member assembly of claim 15, further including an engagement boss extending away from the engagement shoulder of each of the first and second deflectable wings.

17. A trunk cushion member assembly, comprising:

an attachment fastener having deflecting first and second arms each having an end face directed toward a planar flange of the fastener such that the first and second arms define a mushroom shape;

a resilient material cushion member having:

a body first portion;

a body second portion having a hollow chamber, the body second portion integrally connected to the body first portion;

a first bore extending into the body first portion;

a second bore opening into the first bore, the second bore having a diameter larger than a diameter of the first bore and substantially equal to a spaced width of the first and second arms; and a surface separating a cavity defined by the second bore from the first bore, the first and second arms in contact with the surface in an attachment fastener installed position thereby resisting removal of the attachment fastener from the cushion member; and a first neck region integrally connecting the first and second arms to the planar flange, wherein the first and second arms and the first neck region together define a cushion engagement portion entirely received in the first and second bores of the body first portion.

18. The trunk cushion member assembly of claim 17, wherein the body second portion includes an outwardly directed flange oriented transverse to a longitudinal axis of the cushion member.

19. The trunk cushion member assembly of claim 18, wherein a diameter of the flange is greater than a diameter of the body second portion.

20. The trunk cushion member assembly of claim 18, wherein a diameter of the body first portion is less than a diameter of the flange and less than a diameter of the body second portion.

* * * * *